US007121436B2

(12) United States Patent
Lee et al.

(10) Patent No.: US 7,121,436 B2
(45) Date of Patent: Oct. 17, 2006

(54) NON-SPILL WATER BOTTLE CAP FOR PURIFIED WATER DISPENSER

(76) Inventors: Myong-Hoon Lee, 144-63 35th Ave. #5B, Flushing, NY (US) 11354; Won-Hie Choi, 261 Piermont Rd., Cresskill, NJ (US) 07626

( * ) Notice: Subject to any disclaimer, the term of this patent is extended or adjusted under 35 U.S.C. 154(b) by 393 days.

(21) Appl. No.: 10/681,231

(22) Filed: Oct. 9, 2003

(65) Prior Publication Data

US 2005/0077320 A1 Apr. 14, 2005

(51) Int. Cl.
*B65D 47/00* (2006.01)

(52) U.S. Cl. ..... 222/477; 141/364

(58) Field of Classification Search ..... 222/185.1, 222/564, 547, 146.6, 559, 500, 544, 482, 222/477, 65, 67; 215/22; 141/364, 319, 141/320, 322; 137/533.19
See application file for complete search history.

(56) References Cited

U.S. PATENT DOCUMENTS 3,794,202 A * 2/1974 Unger ..... 215/22
4,741,448 A 5/1988 Alley et al. ..... 215/266
5,433,354 A * 7/1995 Jacobsen et al. ..... 222/495
5,819,994 A 10/1998 Leipold ..... 222/541.9
5,988,415 A 11/1999 White ..... 215/266
5,996,860 A 12/1999 Alley ..... 222/564
6,481,601 B1 * 11/2002 Steen ..... 222/500

* cited by examiner

*Primary Examiner*—Michael Mar
*Assistant Examiner*—Sonia N. Khaira
(74) *Attorney, Agent, or Firm*—G W i P S

(57) ABSTRACT

An improved non-spill water bottle cap is developed for preventing water spillage when a water bottle is inverted to place on a water dispenser. The improved non-spill water bottle cap comprises a cylindrical plastic tube (10), a spherical float (20) for controlling the water flow, a plastic cap head (30) integrally formed with the cylindrical plastic tube (10), an edge frame (11) disposed at the end of the cylindrical plastic tube (10) and an annular flange (13) with a plurality of peepholes (13*a*) disposed at the mouth of the plastic cap head (30) for retaining the spherical float (20) inside the cylindrical plastic tube (10), and an annular sealing ridge (12) for momentarily blocking the water flow path by contacting the spherical float (20) to form a seal when the water bottle is inverted.

7 Claims, 4 Drawing Sheets

NON-SPILL WATER BOTTLE CAP FOR PURIFIED WATER DISPENSER

BACKGROUND OF THE INVENTION

1. Field of the Invention

The present invention relates to a non-spill water bottle cap for preventing water spillage when a water bottle is inverted to place on a water dispenser. Particularly, the improved non-spill water bottle cap has an advanced feature for momentarily blocking the water flow path of the water bottle. The improved non-spill water bottle cap consists of a transparent cylindrical plastic tube, a spherical float, an annular flange with a plurality of peepholes and an annular sealing ridge.

2. Description of the Prior Art

Recently, bottled purified water is increasingly consumed by many people due to pollution of drinking water reservoirs. Along with the increase in purified water consumption, bottled purified water and its dispenser became essential devices at many modern offices and homes. Some such devices are also equipped with an electric hot water and cold water dispensing system.

When a water bottle is emptied, a new water bottle must be placed on the dispenser. Before installing a new water bottle, a seal on the water bottle must be removed, then the bottle must be lifted and inverted simultaneously to orient the port vertically downward toward the dispenser. During this replacing process, many people may experience spilling the water on the floor.

A user who has once experienced the water spilling may have anxiety when they place a new water bottle on the dispenser.

In order to solve the spilling problem, many different types of devices are suggested. A typical device is cited here as an example for discussion.

Korean Patent No. 1999-007557 discloses "a device for opening and closing the port of a water bottle for the hot and cold water dispenser" comprising a floating ball, guiding bar, end ring shape support and inserting cap for stopping water spill during the inversion of the bottle.

However, this device has a problem in that the floating ball is frequently stuck in the narrow neck of the water bottle due to water pressure exerted on it. Thus, the user must often shake the water bottle to release the stuck ball from the neck of the water bottle.

Accordingly, it is required to develop a device that can prevent the stuck ball and water spilling problems during the inversion of the water bottle to place on the dispenser.

SUMMARY OF THE INVENTION

In order to overcome the aforementioned problems of the conventional devices, a new concept of improved water bottle cap is introduced for preventing water spillage.

An objective of the present invention is to provide an improved non-spill water bottle cap comprising a transparent cylindrical plastic tube (10) with a plurality of holes (10*a*), a spherical float (20) disposed inside of the transparent cylindrical plastic tube (10) for controlling the water flow, a plastic cap head (30) integrally formed with the transparent cylindrical plastic tube (10), an edge frame (11) disposed at one end of the cylindrical plastic tube (10) for retaining the spherical float (20) inside the cylindrical plastic tube (10), and an annular flange (13) with a plurality of peepholes (I 3*a*) disposed at the mouth of the plastic cap head (30) for retaining the spherical float (20) inside the cylindrical plastic tube (10).

Another objective of the present invention is to provide the non-spill water bottle cap having an annular flange (13) oriented obliquely inward at the mouth of the plastic cap head (30), the cylindrical plastic tube (10) having an annular sealing ridge (12) for momentarily blocking the water flow path by contacting the spherical float (20) when the water bottle is inverted to place on the water dispenser and simultaneously retaining the spherical float (20) inside the cylindrical plastic tube (10).

The diameter of the annular sealing ridge (12) is approximately one-fifth smaller than that of the spherical float (20) and the ridge is disposed at a location equal to approximately one-fourth of a diameter from the mouth of the plastic cap head (30).

The diameter of the cylindrical plastic tube (10) is approximately one-fifth larger than that of the spherical float (20) in order to provide a clearance.

BRIEF DESCRIPTION OF THE DRAWINGS

The following description of the preferred embodiment is given with reference to the accompanying drawings, in which.

DETAILED DESCRIPTION OF THE PREFERRED EMBODIMENT

An improved non-spill water bottle cap has been developed to achieve the above objectives of the present invention. Hereinafter, a detailed description is presented with reference to the accompanying drawings.

Figure 1:
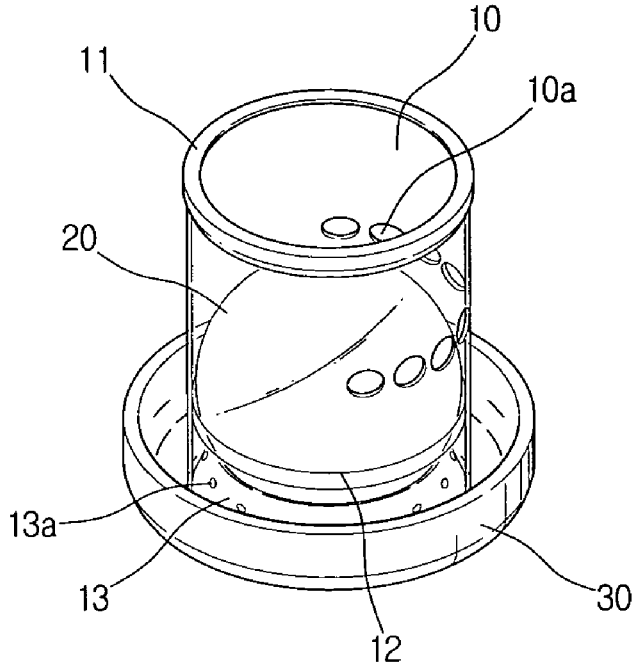
FIG. 1 is a schematic drawing of a non-spill water bottle cap for preventing water spillage according to the present invention.
Figure 2:
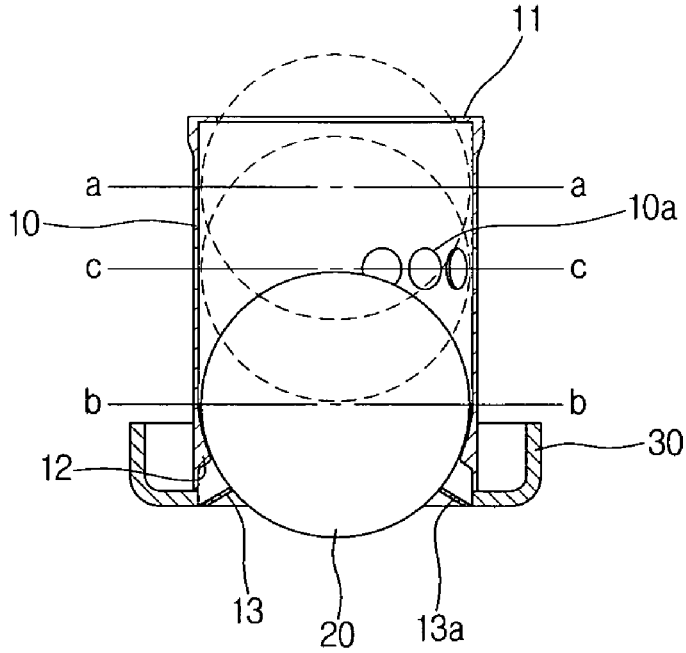
FIG. 2 is a front view of the non-spill water bottle cap of the present invention.
Figure 3:
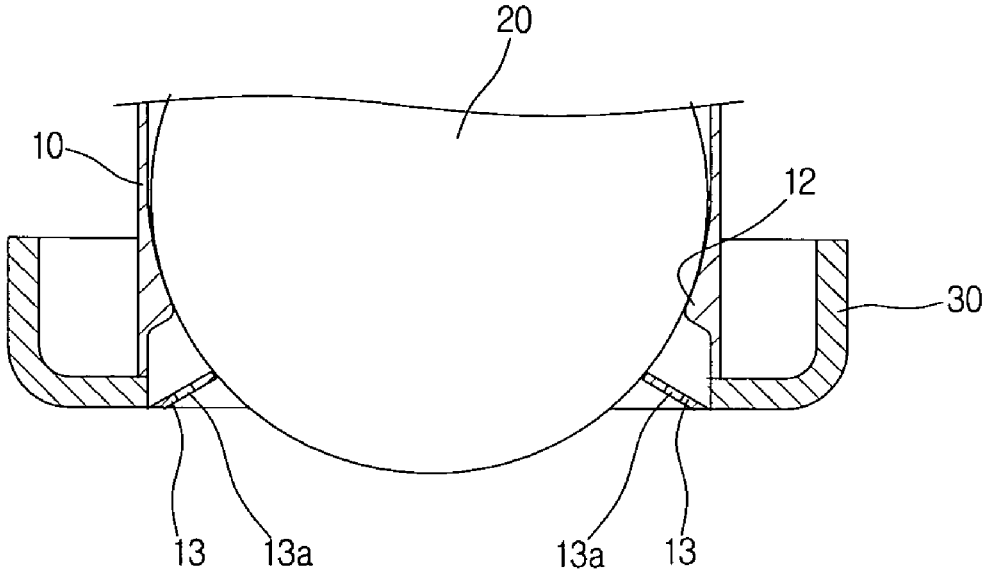
FIG. 3 is an enlarged view for illustrating the configuration of the non-spill water bottle cap.

Referring to FIGS. 1 to 3, an improved non-spill water bottle cap is designed to prevent the water spillage when a water bottle is inverted to be placed on a water dispenser. The improved non-spill water bottle cap comprises a transparent cylindrical plastic tube (10) with a plurality of holes (10*a*), a spherical float (20) disposed inside of the cylindrical plastic tube (10) to control the water flow and a plastic cap head (30) integrally formed with the cylindrical plastic tube (10) for capping on the opening of a water bottle.

A series of multiple holes (10*a*) arranged in a line is located at one third of the tube height from the top edge and on only one side of the tube, so that the water can flow into the tube from one side to rotate the spherical float (20). However, it is possible to arrange the many holes in any pattern or location on the wall of the cylindrical plastic tube (10). The cylindrical plastic tube (10) can be made of a Lucite tube as one piece or joined to a plastic screen or net above the position b—b, as shown in FIG. 2.

A passage for air and water flow is also provided between the cylindrical plastic tube (10) and the spherical float (20). The clearance of the water-air passage is provided in such a way that the diameter of cylindrical plastic tube (10) is approximately one-fifth larger than the diameter of the spherical float (20).

An edge frame (11) is disposed at one end of the cylindrical plastic tube (10) for retaining the spherical float (20) inside the tube (10). An annular flange (13) is attached to the mouth of the plastic cap head (30) for retaining the spherical float (20) inside the tube (10). A plurality of peepholes (13*a*) is located along the center of the annular flange (13) for allowing the passage of air and water flow.

As shown in FIG. 3, the annular flange (13) is oriented obliquely inward at the mouth of the plastic cap head (30).

An annular sealing ridge (12) is located at the lower part of the inner wall of the cylindrical plastic tube (10) for momentarily blocking the water flow path by contacting the spherical float (20) to form a seal when the water bottle is inverted to place on the water dispenser. The annular sealing ridge (12) also acts as a retainer for retaining the spherical float (20) inside the cylindrical plastic tube (10). The diameter of the annular sealing ridge (12) is approximately one-fifth smaller than that of the spherical float (20). The annular sealing ridge (12) is formed at a location equal to approximately one-fourth the diameter of the spherical float (20) from the mouth of the plastic cap head (30). By design, the annular sealing ridge (12) and the tip of the annular flange (13) are simultaneously in contact with the spherical float (20).

Therefore, the spherical float (20) is able to move from point a—a to point b—b passing through point c—c, i.e. the movement of the spherical float (20) is restricted between the edge frame (11) and annular sealing ridge (12). While the spherical float (20) is moving along the cylindrical plastic tube (10) between the points a—a and c—c, the amount of water flow is controlled by the displaced water through the tube.

Figure 4:
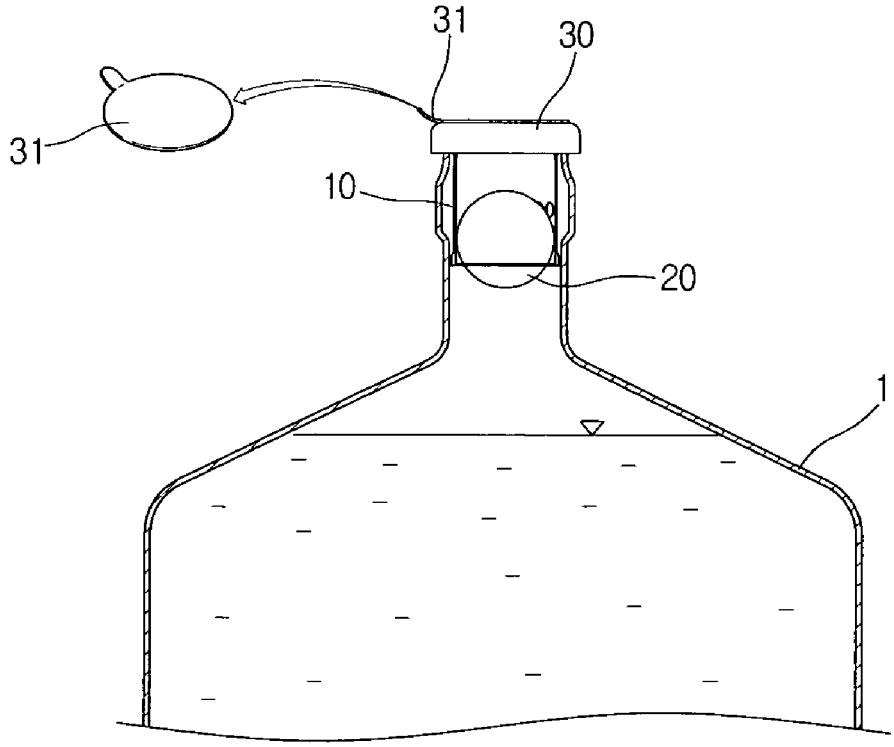
FIG. 4 is an upright water bottle employing the non-spill water bottle cap.

As shown in FIG. 4, a non-spill water bottle cap of the present invention is capped to the upright water bottle. A security seal (31) may be installed to prevent the entry of foreign objects or water spillage during delivery when the present non-spill water bottle cap is installed at a manufacturing facility or distribution center. Otherwise, the security seal (31) may not be included for sale on the market as an accessory part.

Before inverting the water bottle, the security seal (31) is peeled off for placing the water bottle on the dispenser.

Figure 5:
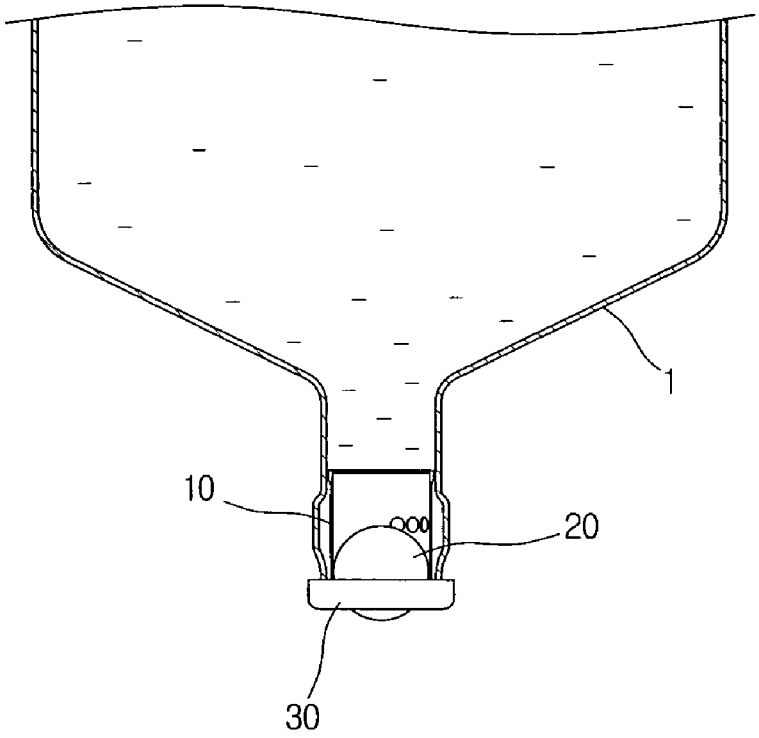
FIG. 5 is an inverted water bottle employing the non-spill water bottle cap.
Figure 6:
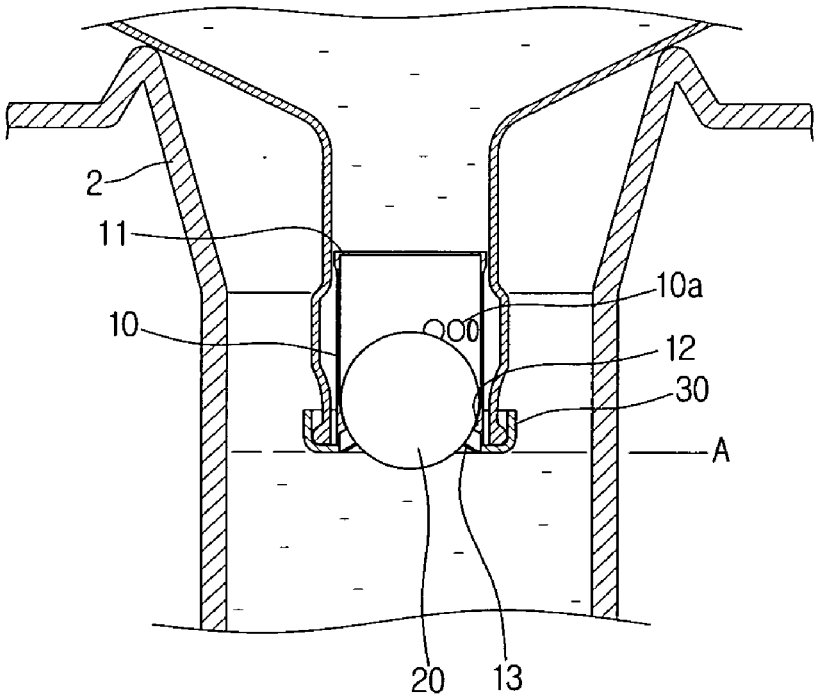
FIGS. 6 through 8 illustrate the process of controlling the water flow through the non-spill water bottle cap of the present invention.

As shown in FIGS. 5 and 6, the water bottle with the present non-spill water bottle cap is inverted and placed on the water dispenser. At this point, the spherical float (20) is pressed into contact with the annular sealing ridge (12) and the tip of the annular flange (13) at the same time by the water pressure, momentarily blocking the water flow. The present cap is designed such that approximately one-fourth of the diameter of the spherical float (20) protrudes from the port of the water bottle when in this position.

Figure 7:
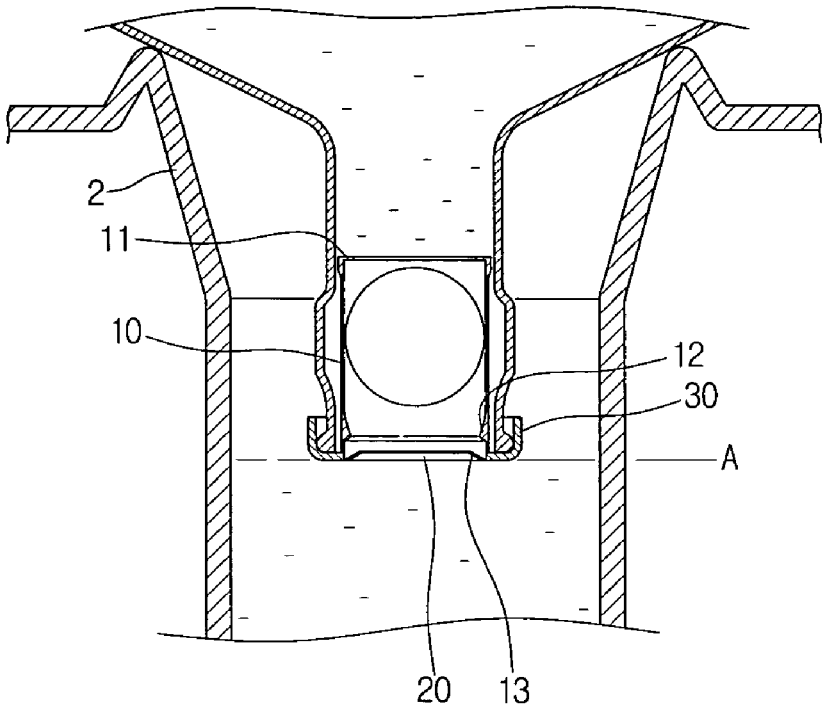
Figure 8:
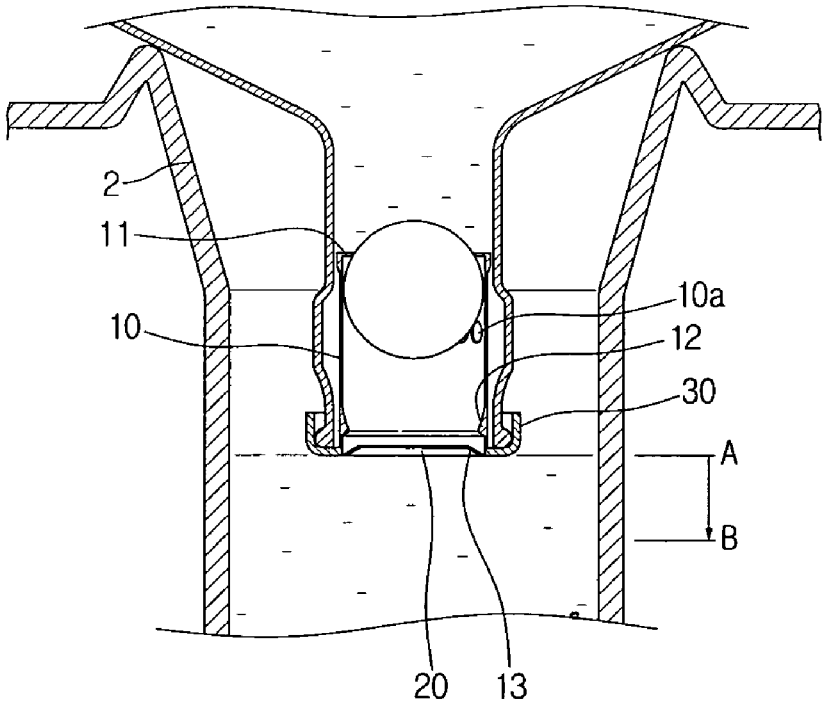

Referring to FIGS. 6 through 8, the process of controlling the water flow through the non-spill water bottle cap of the present invention is described in detail.

As shown in FIG. 6, the inverted water bottle is placed on the water dispenser. At this point, the water in the bottle is leaking down between the contacting surfaces of the annular sealing ridge (12) and the spherical float (20). As time elapses, the amount of leaking water rapidly increases, to fill the airspace below the spherical float (20). As the airspace is filled with the leaking water, the water flow from the bottle gradually decreases and finally stops when the water has filled the entire airspace.

As the water bottle approaches pressure equilibrium, the spherical float (20) begins to rise as shown in FIG. 7 and reaches the top of the cylindrical plastic tube (10) as shown in FIG. 8.

Referring to FIG. 8, when the water level is lowered from position A to position B, i.e. someone turns on the water from the water dispenser to drink, the water flows out from the water bottle by gravitational force. As the water flows out from the bottle, the spherical float (20) in the cylindrical plastic tube (10) is moved down and the vacuum pressure in the closed water bottle is increased. When the vacuum pressure is increased to a certain level, the air outside of the bottle starts to flow into the water bottle. At this point, the vacuum pressure and the buoyant force act on the spherical float (20) to rise upward in the cylindrical plastic tube (10) against the gravitational flow force. As the spherical float (20) rises up, the water fills into the cylindrical plastic tube (10) to flow out from the water bottle. As the water in the cylindrical plastic tube (10) flows out, the spherical float (20) sinks down. This simple process is rapidly repeated until the water level in the dispenser reaches position A again. Through this water dispensing process, it is possible to control the water flow from the water bottle.

While the present invention has been described in detail with its preferred embodiments, it should be understood that further modifications are possible. The present application is therefore intended to cover any variations, uses or adaptations of the invention following the general principles thereof, and includes such departures from the present disclosure as come within known or customary practice in the art to which this invention pertains within the limits of the appended claims.

What is claimed is:

1. An improved non-spill water bottle cap for preventing water spillage when a water bottle is inverted to be placed on a water dispenser, said improved non-spill water bottle cap comprising:

a cylindrical transparent plastic tube (10) with a series of holes (10*a*) linearly arranged along half of the circumference, midway along the length of said cylindrical transparent plastic tube (10), a spherical float (20) disposed within said cylindrical transparent plastic tube (10) to control the water flow through said tube, a plastic cap head (30) having a mouth opening, integrally formed with a front end of said cylindrical transparent plastic tube (10) to cap onto a port of said water bottle, an edge frame (11) disposed at a rear end of said cylindrical transparent plastic tube (10) for retaining said spherical float (20) within said cylindrical transparent plastic tube (10), an annular flange (13) with a series of circumferential pinholes (13*a*) therein, located along an edge of said mouth opening of said plastic cap head (30) for retaining said spherical float (20) within said cylindrical transparent plastic tube (10), and an annular sealing ridge (12) integrally formed around the circumference of a front inner wall portion of said plastic tube with a spherically curved mating surface for momentarily blocking the water flow path by contacting said spherical float (20) when the water bottle is inverted to be placed on the water dispenser.

2. An improved non-spill water bottle cap as claimed in claim 1, wherein said annular flange (13) is oriented obliquely inward at the mouth of said plastic cap head (30) and said series of pinholes (13*a*) are located along the center of the annular flange (13) for passing the flow of air and water.

3. An improved non-spill water bottle cap as claimed in claim 1, wherein said annular sealing ridge (12) is located adjacent to said annular flange (13).

4. An improved non-spill water bottle cap as claimed in claim 3, wherein said annular sealing ridge (12) has an inner diameter approximately one-fifth smaller than the diameter of said spherical float (20).

5. An improved non-spill water bottle cap as claimed in claim 3, wherein said annular sealing ridge (12) is located approximately one-fourth of the diameter of said spherical float (20) away from said mouth of the plastic cap head (30).

6. An improved non-spill water bottle cap as claimed in claim 3, wherein said annular sealing ridge (12) and a tip of said annular flange (13) are designed to simultaneously contact said spherical float (20) due to water pressure in order to momentarily block the water flow through the water bottle.

7. An improved non-spill water bottle cap as claimed in claim 1, wherein said cylindrical transparent plastic tube (10) has a diameter approximately one-fifth larger than said spherical float (20) for passing the flow of air and water.

* * * * *